United States Patent [19]

Beduhn et al.

[11] 4,387,813

[45] Jun. 14, 1983

[54] MOVABLE RING SUPPORTED LIFT CRANE

[75] Inventors: Daniel E. Beduhn; James G. Morrow, Sr., both of Manitowoc, Wis.

[73] Assignee: The Manitowoc Company, Inc., Manitowoc, Wis.

[21] Appl. No.: 300,016

[22] Filed: Sep. 8, 1981

Related U.S. Application Data

[63] Continuation of Ser. No. 58,284, Jul. 17, 1979, abandoned.

[51] Int. Cl.[3] ..... B66C 23/73; B66C 23/78

[52] U.S. Cl. ..... 212/195; 212/189; 280/402; 280/415 R

[58] Field of Search ..... 212/182–183, 212/188–189, 195, 198, 223–224, 232, 237–238, 212/245, 245–248, 254–255; 280/402, 415 R

[56] References Cited

U.S. PATENT DOCUMENTS

| | | | |
|---|---|---|---|
| 3,680,720 | 8/1972 | Strange . | |
| 3,836,011 | 9/1974 | Lampson . | |
| 3,868,022 | 2/1975 | Greenlay et al. . | |
| 4,020,952 | 5/1977 | Scodino | 212/189 |
| 4,241,803 | 12/1980 | Lauber | 212/189 |

FOREIGN PATENT DOCUMENTS

| | | | |
|---|---|---|---|
| 267134 | 2/1964 | Australia | 212/189 |
| 2441278 | 3/1970 | Fed. Rep. of Germany | 212/189 |
| 1436263 | 3/1966 | France | 212/195 |

*Primary Examiner*—Trygve M. Blix
*Assistant Examiner*—R. B. Johnson
*Attorney, Agent, or Firm*—Leydig, Voit, Osann, Mayer & Holt, Ltd.

[57] ABSTRACT

A front and rear pair of crawler assemblies are provided for supporting the ring of a ring supported crane so the crane can travel under load. The front pair of crawler assemblies which form an independent transporter mechanism are selectively and reversely powered to facilitate forward and reverse as well as turning movement. The rear pair of crawler assemblies are disposed in idling arrangement.

4 Claims, 3 Drawing Figures

MOVABLE RING SUPPORTED LIFT CRANE

This application is a continuation of application Ser. No. 058,284, filed on July 17, 1979, and now abandoned, which is herein incorporated by reference.

This invention relates generally to lift cranes and more particularly concerns a mobile ring supported crane.

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383 and 3,878,944, assigned to the assignee of the present invention. In this design, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

Further refinements in ring supported cranes are disclosed in U.S. Pat. Nos. 4,042,115 and 4,103,783 also assigned to the assignee of the present invention. These patents disclose inter alia that a separate transporter mechanism may be run in and out of an otherwise stationary ring supported crane in order to move that crane between different locations or job sites.

The primary aim of the present invention is to provide a transporter arrangement which permits such a ring supported crane to travel under load.

It is also an object of the invention to provide an arrangement as characterized above that can rapidly be set up for crane operation so as to increase the mobility and maneuverability of a crane using the track-like ring support.

Figure 1:
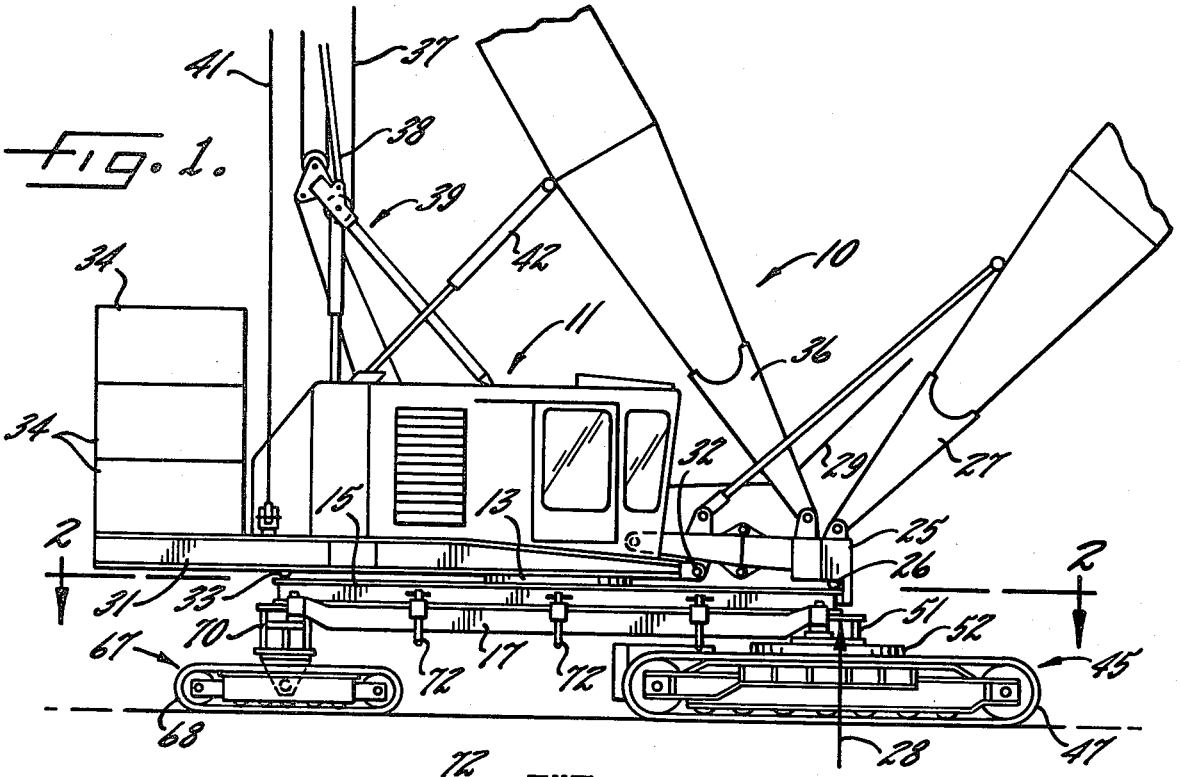
Figure 2:
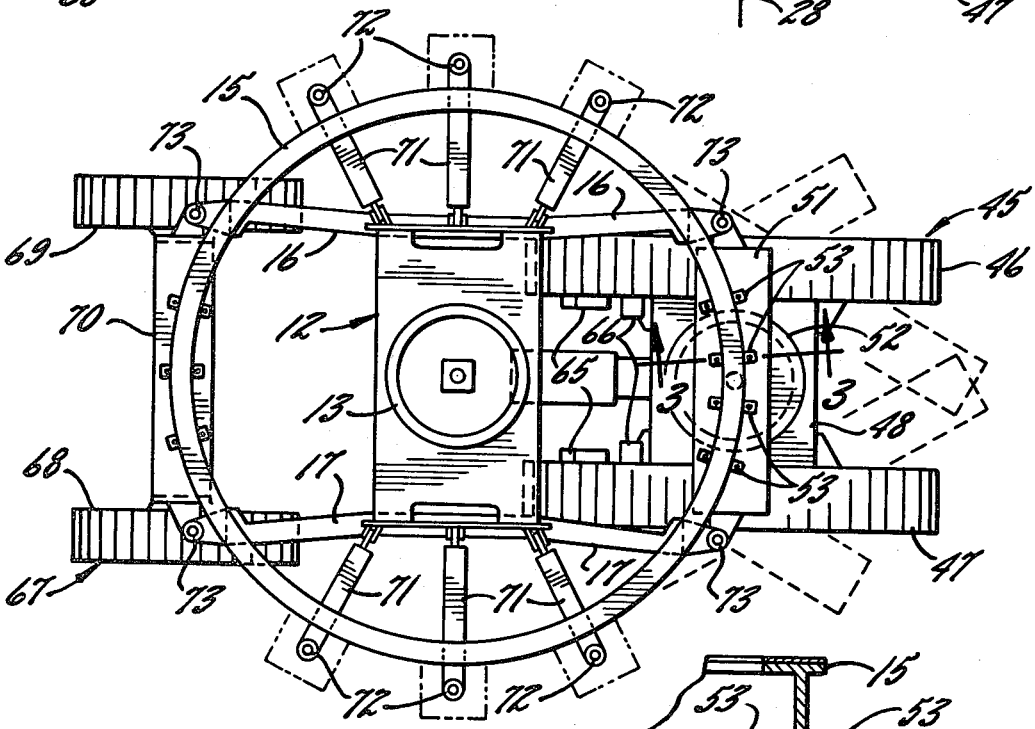
Figure 3:
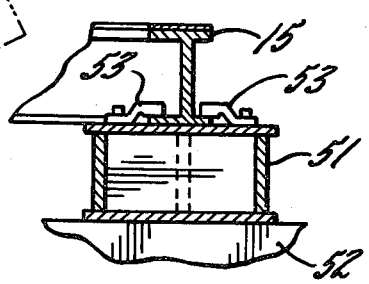

Other objects and advantages of the invention will become apparent upon reading the following detailed description and upon reference to the drawings, in which:

FIG. 1 is a fragmentary elevation of a crane support structure embodying the present invention; and FIGS. 2 and 3 are sections taken approximately along the lines 2—2 in FIG. 1 and 3—3 in FIG. 2, respectively.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning to the drawings, there is shown a crane 10 having an upper structure 11 mounted for rotation on a car body 12 through a roller path 13. In order to increase the capacity of the crane 10, a track-like ring 15 is secured to the ends of support beams 16 and 17 so as to horizontally surround the car body 12. Preferably, the ring has an I-beam cross section with a hardened upper path surface. To adapt the crane for this ring support configuration, the support beams 16, 17 are secured to the car body 12 so that the beams become part of the car body.

The geometry of the crane 10 contributes to its high capacities when used with the ring support. A boom carrier 25 is pivoted for vertical movement on the upper structure 11 and provided with a roller assembly 26 for rotation on the ring 15. A boom 27 is mounted on the carrier at what becomes the load lifting fulcrum 28 of the system, and a load lift line 29 runs along and over the end of the boom 27. A counterweight carrier 31 is also pivoted for vertical movement at 32 on the upper structure 11 and the carrier extends the opposite direction from the boom carrier 25 to ride on the ring 15 through roller assemblies 33, only one of which is shown. Counterweights 34 are stacked on the carrier 31.

In effect, all structure to the non-boom side of the fulcrum 28 is available for counterbalancing and stabilizing the crane 10. Preferably, a mast 36 is mounted on the carrier 25 and boom lift rigging 37 interconnects the tops of the mast 36 and the boom 27 for moving the boom vertically. The mast 36 is secured by pendants 38 to gantry structure 39 on the upper structure 11 to form a substantially rigid assembly, and other pendants 41 provide substantially rigid connections between the counterweight carrier 31 and the top of the mast 36. Struts 42 establish the substantially fixed angular position to the mast 36. This geometry creates a stable, high capacity crane.

In accordance with the present invention, a traveling support arrangement 45 is provided for supporting the ring 15 under the fulcrum 28 to permit movement of the crane 10 and ring 15 over the ground while the boom 27 is lifting a heavy load. In the preferred embodiment the traveling support 45 includes a pair of laterally spaced crawler assemblies 46 and 47 respectively located adjacent the forward ends of the support beams 16 and 17. The crawler assemblies 46, 47 are connected together by a frame element or car body 48 which, in turn, is pivotally interconnected to a frame element 51 on which the ring 15 is supported. Preferably, the frame element 51 is connected to the car body 48 through a turntable 52 and to the ring 15 through a plurality of shear plates 53 and lugs.

When a heavy load is lifted by the boom 27, the forces are transmitted down through the boom 27 and mast 36 to the boom carrier 25 riding on the ring 15 adjacent the fulcrum 23. The lifting forces are also transmitted through pendants 41 to the counterweights 34 stacked on the carrier tending to lift the carrier 31 off the ring 15. Since the attachment frame element 51 supports the ring 15 adjacent the fulcrum 28, the lifting forces pass primarily down through the ring 15 to the transport assembly and are resisted by the crawler assemblies 46, 47 engaging the ground.

In keeping with the present invention each of the crawler assemblies 45, 46 is independently powered to move the crane 10 under load by selectively and reversibly powering the crawlers 45, 46 such as by independent fixed and variable displacement hydraulic motors 65 and 66, respectively, such as shown in U.S. Pat. No. 4,000,784, which is incorporated herein by reference. Operation of these motors 65, 66 not only increases the traction power of the crane 10, since the load is primarily supported on the crawlers 45, 46, but also, insures more positive steering control when the crane is moved in a curved path.

Pursuant to another aspect of the invention, the rear portion of the ring 15 is provided with support means 67 to support the ring during travel and to resist rearward tipping of the crane 10 and ring 15 when a heavy load is not being supported by the boom 27. This avoids the necessity of removing portions of the counterweight 34 from the carrier between successive heavy lift operations. Preferably, the support means 67 includes a pair of laterally spaced crawler assemblies 68 and 69 respectively located adjacent the rear ends of the support beams 16 and 17. The crawler assemblies are connected together by a cross frame 70 on which the rear portion of the ring is supported.

It should also be appreciated that the traveling support arrangement 45 and support means 67 may be quickly and conveniently attached and detached from a standard ring supported crane such as disclosed in U.S. Pat. No. 4,103,783 which is incorporated herein by reference. As shown in that patent, a plurality of ring support arms 71 are pivoted for vertical movement on the car body 12 and extend outwardly to underlie the ring 15 at spaced points around the ring periphery. A plurality of jacks 72 are positioned one at the end of each of the arms 71 with the jacks 72 being sized so as to engage the ground when extended and lift the ring 15 and the car body 12 from the ground.

To facilitate setting up the ring 15, hydraulic jacks 73 are mounted at the four ends of the support beams 16, 17. Manipulation of these jacks 73 allows the ring 15 to be lifted and leveled, whereupon the manual jacks 72 can be quickly extended to provide firm support for the ring completely around its periphery and to facilitate coupling and uncoupling the traveling support arrangement 45 and/or the support means 67.

We claim as our invention:

1. In a crane assembly having an upper structure pivoted on a lower car body, the combination comprising, a pair of support beams secured to and forming a part of said lower car body, a track-like ring secured to said beams and horizontally surrounding said lower car body, said beams extending fore and aft beneath and beyond the periphery of said ring, a boom carrier pivoted for vertical movement on said upper structure and riding for rotation on said ring, a boom mounted on said boom carrier for lifting a load, a counterweight carrier pivoted for vertical movement on said upper structure and riding for rotation on said ring, means interconnecting said counterweight carrier and said boom for counteracting a heavy load, and a traveling support for said ring and crane assembly including front and rear pairs of laterally spaced crawler assemblies respectively attached outboard of said ring to the projecting ends of said pair of beams and means including respective frame elements interconnecting the crawler assemblies of each of said front and rear pairs and for supporting said ring between the ends of said support beams, a turntable mounted on the frame element of said front crawler assemblies, a second frame element mounted on the upper portion of said turntable, means for attaching at least a portion of said ring to said second frame element, and said pair of front crawler assemblies each including an endless track and hydraulic motor means for selectively and reversibly driving said tracks to permit movement of said crane and ring over the ground while said boom is lifting a heavy load.

2. The combination of claim 1 wherein said front pair of crawler assemblies are constructed as an independent self-propelled transporter unit which may be readily attached and detached from said ring.

3. The combination of claim 1 wherein said rear pair of crawler assemblies include tracks disposed for idling movement.

4. The combination of claim 1 wherein hydraulic jack means are provided at the ends of said pair of support beams for raising and lowering said front and rear pairs of crawler assemblies.

* * * * *